US005799728A

United States Patent [19]

Blume

[11] Patent Number: 5,799,728

[45] Date of Patent: Sep. 1, 1998

[54] DEHUMIDIFIER

[75] Inventor: Bryan Blume, Troy, Mo.

[73] Assignee: MEMC Electric Materials, Inc., St. Peters, Mo.

[21] Appl. No.: 641,179

[22] Filed: Apr. 30, 1996

[51] Int. Cl.[6] ..... F24F 5/00; F25D 17/02; F25D 21/06; F25D 21/02

[52] U.S. Cl. ..... 165/231; 165/232; 165/97; 62/282; 62/82; 62/93; 62/95; 62/120; 62/140; 62/155

[58] Field of Search ..... 165/231, 232, 165/97; 62/282, 82, 83, 95, 120, 140, 155

[56] References Cited

U.S. PATENT DOCUMENTS

| | | | |
|---|---|---|---|
| 1,967,019 | 7/1934 | Buchanan . | |
| 2,522,484 | 9/1950 | Ringquist et al. | 62/95 |
| 2,763,132 | 9/1956 | Jue | 62/82 |
| 2,896,425 | 7/1959 | Dunbar | 62/282 |
| 3,058,317 | 10/1962 | Putnam . | |
| 3,572,052 | 3/1971 | Toth | 62/90 |
| 3,831,392 | 8/1974 | Hafner et al. | 62/140 |
| 4,122,892 | 10/1978 | Delaporte | 62/282 |
| 4,200,442 | 4/1980 | Willot | 62/93 |
| 4,905,476 | 3/1990 | Cinacchi | 62/93 |
| 5,226,285 | 7/1993 | Dankowski | 165/97 |

*Primary Examiner*—John K. Ford
*Attorney, Agent, or Firm*—Senniger, Powers, Leavitt & Roedel

[57] ABSTRACT

Apparatus for dehumidifying air comprising two cooling coils operable in a first mode for circulating coolant at a temperature above 32° F. and below the dew point of the air through one of the coils and for circulating coolant at a temperature below 32° F. through the other, and operable in a second mode wherein the circulation of coolant is reversed. In one version of the apparatus, shown in FIG. 1, air flows continuously in one direction first through one coil and then the other; in another version of the apparatus, shown in FIG. 3, the direction of air flow is also reversed.

15 Claims, 2 Drawing Sheets

DEHUMIDIFIER

BRIEF SUMMARY OF THE INVENTION

This invention relates to dehumidifiers and more particularly to apparatus for dehumidifying air.

The invention is directed toward apparatus for reducing the humidity of large volumes of air, being particularly useful where low humidity levels are required, as in "clean rooms" (e.g. rooms where silicon wafers are handled). Heretofore, dehumidifying apparatus of the type employing a desiccant has often been needed to meet requirements for low humidity conditions in clean rooms, but such apparatus has considerable initial cost, considerable cost of energy for operation, and sometimes has been low reliability. Among the several objects of this invention may be noted the provision of such apparatus of relatively lower initial cost, and operable with relatively lower cost of energy and with relatively higher reliability.

In general, air dehumidifying apparatus of this inventions comprises two cooling coils, means for blowing air to be dehumidified through the coils, for condensation of moisture from the air thereon, a first source of coolant at a temperature above 32° F. and below the dew point of the air, and a second source of coolant at a temperature below 32° F., the coils being connected with said sources of coolant in a circuit including valving for alternate operation of the apparatus in a first mode for circulation of coolant from the first source through one coil and circulation of coolant from the second source through the other coil and a second mode for circulation of coolant from the second source through said one coil and circulation of coolant from the first source through said other coil.

The apparatus further comprises means for controlling the valving for effecting operation of the apparatus in cycles with each cycle involving operation of the apparatus in the first mode until said other coil freezes up and then shifting to operation in the second mode, until said one coil freezes up, and then shifting to operation in the first mode, and repeating the cycle.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
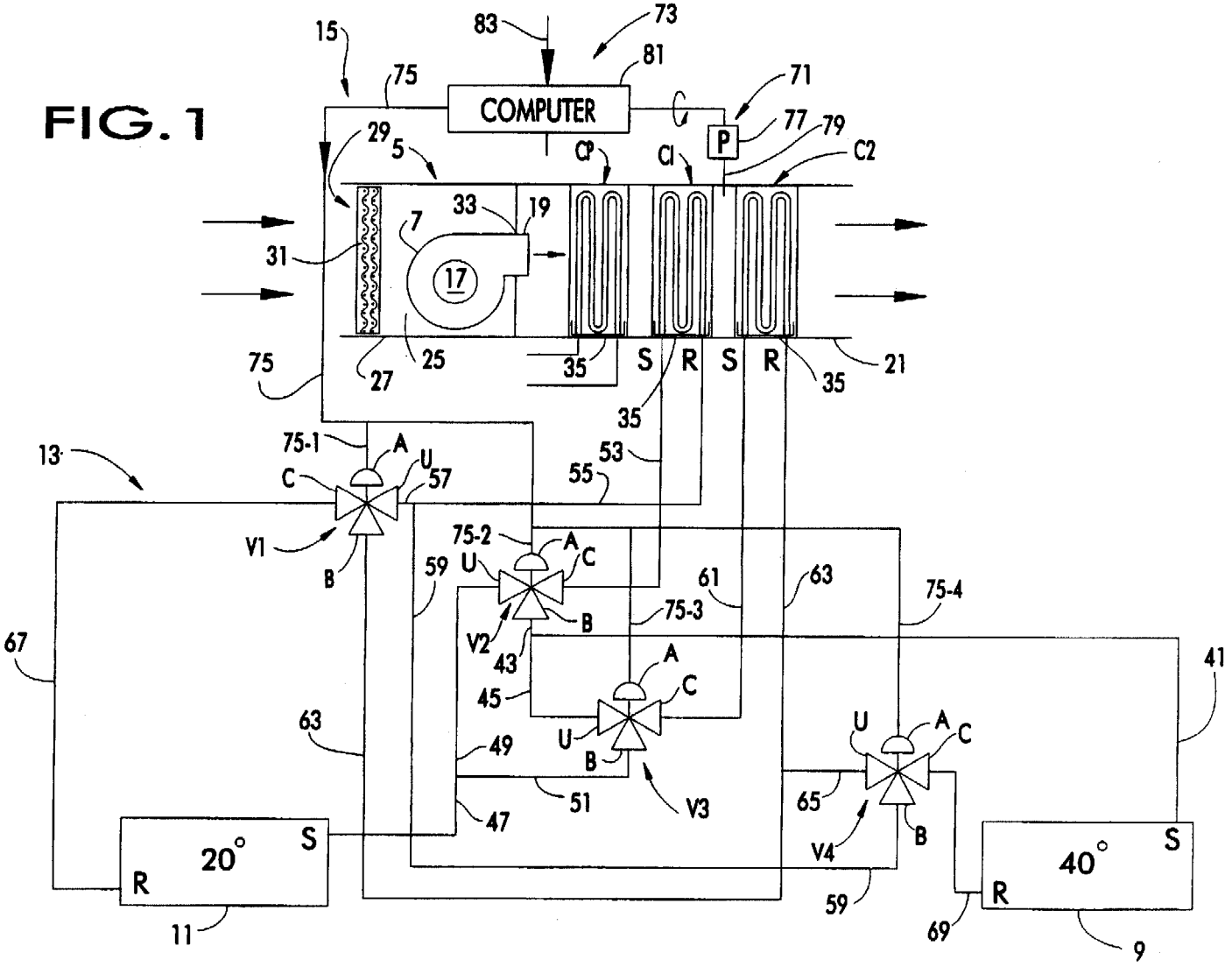
FIG. 1 is a semi-diagrammatic view of a first version of the air dehumidifying apparatus of this invention, showing the aforementioned valving and means for controlling the valving.

Referring to FIG. 1 of the drawings, a first version of the dehumidifying apparatus of this invention is shown to comprise two cooling coils designated C1 and C2. As shown in FIG. 1 these are the primary coils of a series of three coils, arranged for flow of air to be dehumidified therethrough in series, first through a pre-chilling coil designated CP and thence through coils C1 and C2. At 5 is generally indicated means including a blower 7 for blowing air to be dehumidified through the coils, one after the other, for condensation of moisture from the air in the coils. At 9 is indicated a first source of coolant (e.g. ethylene glycol) at a temperature above 32° F. and below the dew point of the air which is to be dehumidified, and at 11 is indicated a second source of coolant (e.g. ethylene glycol) at a temperature below 32° F. By way of example, coolant may be delivered from the first source 9 at 40° F. and coolant may be delivered from the second source 11 at 20° F., sources 9 and 11 being so marked in FIG. 1. The primary coils C1 and C2 are connected with the sources of coolant 9 and 11 in a hydraulic circuit indicated in its entirety at 13 including valving (to be subsequently described in detail) for alternative operation of the apparatus in a first mode for circulation of coolant from the first source 9 through one coil (coil C1) and circulation of coolant from the second source 11 through the other coil (coil C2) and in a second mode for circulation of coolant from the second source 11 through said one coil (coil Cl) and circulation of coolant from the first source 9 through said other coil (coil C2). At 15 is generally indicated means (to be subsequently described in detail) for controlling the valving for effecting operation of the apparatus in cycles with each cycle involving operation in the first mode until said other coil freezes up and then shifting to operation in the second mode, until said one coil freezes up, and then shifting to operation in the first mode.

With specific reference to the first source 9 of coolant as supplying coolant at 40° F. and the second source of coolant as supplying coolant at 20° F., it will be observed that operation of the apparatus in the stated first mode involves circulation of the 40° F. coolant through coil C1 and circulation of the 20° F. coolant through coil C2, and operation of the apparatus in the stated second mode involves circulation of the 20° F. coolant through coil C1 and circulation of the 40° F. coolant through coil C2. Coolant, e.g. ethylene glycol at a temperature above 32° F. and below the dew point of the air to be dehumidified, is continuously circulated through the pre-chilling coil CP. This may be supplied from source 9 or a separate source.

Each of the cooling coils C1, C2 and CP may be a conventional commercially available coil. The blower 7 may be a conventional commercially available centrifugal blower, its inlet being indicated at 17 and its outlet being indicated at 19. The coils C1 and C2 are located in ductwork such as indicated at 21 along with the pre-chilling coil Cp, the latter being located in the ductwork 21 upstream from coil C1 (the latter being located upstream from coil C2 in the ductwork). The blower is situated in a chamber 25 defined by housing means 27 having an inlet at 29 for the air to be dehumidified, the inlet having a filter 31 therein for filtering the air before it reaches the inlet 17 of the blower. The chamber 25 has an outlet indicated at 33, the outlet 19 of the blower extending through this outlet into the ductwork 21 for blowing the air through the ductwork and sequentially through the cooling coils CP, C1 and C2. Moisture in the air flowing through the ductwork 21 is condensed on the coils thus dehumidifying the air. Each coil is shown as having a drain 35 at the bottom thereof in which the condensate is collected and by means of which it is drained off out of the ductwork.

The valving of the hydraulic circuit 13 is shown in FIG. 1 as comprising four valves V1, V2, V3 and V4, each of which may be a standard commercially available pneumatically operable 3-way valve having first, second and third transfer ports designed B, C and U for coolant, and a pneumatic control port A for control air. Each valve is of the type having a first setting in which its port B is open to its port C and its port U is blocked and a second setting in which its port U is open to its port C and its port B is blocked. As will appear, with the valves in their first setting, the apparatus operates in the stated first mode, and with the valves in their second setting the apparatus operates in the second mode. On drop of air pressure at the pneumatic control port of each valve to a lower limit (e.g. drop to zero pressure), the valve assumes its first setting and maintains this until air at an elevated pressure (e.g. 15 psi) is delivered to the control port, whereupon it shifts to its second setting. Each of the chillers 9 and 11 is a recirculating type of chiller having means (not shown) for pumping coolant which is chilled therein through an outlet S (S for "supplying") and an inlet R (R for "return") for return recirculation of the coolant. A pipe 41 extending from outlet S of chiller 9 has a branch 43 connected to port B of valve V2 and a branch 45 connected to port U of valve V3. A pipe 47 extending from outlet S of chiller 11 has a branch 49 connected to port U of valve V2 and a branch 51 connected to port B of valve V3. A pipe 53 interconnects port C of valve V2 to one end 1*a* of coil 1 constituting its upstream or inlet end. A pipe 55 extending from the other end constituting the downstream or discharge end of 1*b* coil 1 has a branch 57 connected to port U of valve V1 and a branch 59 connected to port B of valve V4. A pipe 61 interconnects port C of valve V3 and the inlet end C2*a* of coil C2. A pipe 63 interconnects the discharge end of C2*b* coil C2 and port B of valve V1, with a branch connection 65 to port U of valve V4 a pipe 67 interconnects port C of valve V1 and the return inlet R of chiller 11, and a pipe 69 interconnects port C of valve V4 and the return inlet R of chiller 9.

In response to drop of pressure to the aforesaid lower limit (e.g. zero) at the control port A of each of the valves V1–V4, port B of each valve is opened to port C of the valve, and this effects operation of the apparatus in the stated first mode for circulation of coolant at a temperature above 32° F. and below the dew point of the air to be dehumidified (e.g. 40° F.) from the stated first source 9 through coil C1 and circulation of coolant from the stated second source 11 at a temperature below 32° F. (e.g. 20° F.) through coil C2. In response to delivery of air at the stated upper pressure limit (e.g. 15 psi) to the control port A of each of the valves V1–V4, port B of each valve is closed and port U of each valve is opened to the respective port C, and this effects operation of the apparatus in the stated second mode for circulation of coolant from source 11 (e.g. at 20° F.) through coil C1 and circulation of coolant from source 9 (e.g. at 40° F.) through coil C2. Thus, in the first mode (ports B open to ports C of the valves), coolant flows from the discharge outlet S of the first source 9 through pipes 41 and 43, ports B and C of valve V2, pipe 53 to coil C1, through the coil 1, pipe 55, pipe 59 port B and C of valve V4 and pipe 69 to the inlet R of source 9. And coolant flows from the discharge out S of source 11 through pipe 47, pipe 51, ports B and C of valve V3, pipe 61 to coil C2, through coil C2, pipe 63, ports B and C of valve V1 and pipe 67 to the inlet of source 11. In the second mode (ports B closed, each port U opened to the respective port C), coolant flows from the discharge outlet S of the second source 11 through pipes 47 and 49, ports U and C of valve V2, pipe 53 to coil C1, through the coil C1, pipes 55 and 57, ports U and C of valve V1 and pipe 67 to the inlet R of source 11. And coolant flows from the discharge outlet S of first source 9 through pipes 41 and 45, ports U and C of valve V3, pipe 61 to coil C2, through the coil C2, pipes 63 and, ports U and C of valve V4 and pipe 69 to the inlet R of source 9.

The means or system 15 for controlling the valves V1–V4 is shown in FIG. 1 as comprising means such as indicated at 71 for sensing the pressure of air in the ductwork 21 between the coils C1 and C2, and means indicated at 73 responsive to the pressure-sensing means 71 for controlling delivery of control air via a control air line 75 to the control ports A of valves V1–V4. The pressure-sensing means 71 comprises a pressure sensor 77 located outside the ductwork 21 which senses the pressure of air in the ductwork between coils C1 and C2 via an air line 79 extending thereto from the space in the ductwork between these coils. The control means 73 for controlling delivery of control air to ports A via line 75 comprises a computer-controlled air control device which controls delivery of air from a suitable source of air under pressure (not shown) to the control air line 75. The computer-controlled device acts to cut off the delivery of air to line 75 and vent air from line 75 in response to the air pressure sensor 77 sensing low air pressure in the ductwork 21 between the coils 1 and 3, and to deliver air under pressure via line 75 and the branch lines indicated at 75-1, 75-2, 75-3 and 75-4 in FIG. 1 to the control port A of each of the four valves V1–V4. The low and high air pressure points at which the computer-controlled device cut off and on are adjustable by means of the computer thereof.

The pressure in the ductwork 21 between coils 1 and 3 sensed by the pressure sensor 77 varies generally in accordance with increase and decrease of ice on coil C2. It will be understood that with air to be dehumidified flowing through coil C2, and coolant at a temperature (e.g. 20° F.) below the freezing point of water, moisture in the air condenses on the coil and freezes, the build-up of the ice on the coil impeding the flow of air through the coil, resulting in increase of the pressure of air in the ductwork 21 upstream from the coil 3. By circulating coolant (ethylene glycol) at a temperature (e.g. 40° F.) above 32° F., the ice is melted, thereby unblocking the coil C2 for increased flow of air therethrough and resultant drop of pressure of air in the ductwork 21 upstream of coil C2.

Operation of the apparatus illustrated in FIG. 1 is as follows:

Assuming that at the start of operating both coils C1 and C2 are ice-free, having been de-iced if they had been previously iced by reason of ambient temperature being above 32° F. and any ice that had been thereon at the conclusion of previous operation having melted. Under these conditions, pressure in the ductwork 21 as sensed by the pressure sensor is low, and the computer-controlled device for controlling the control air acts to cut off delivery of air to the control air line 75 (and to vent air from this line). As a result, the control port A of each of the four valves V1–V4 is subject to a zero psi signal, and the valves are set in their above-noted first setting (ports B open to ports C), and the apparatus operates in the stated first mode wherein coolant from the first source 9 (e.g. 40° F. coolant) is circulated through coil C1 and coolant from the second source 11 (e.g. 20° F. coolant) is circulated through coil C2. This mode of operation continues until ice accumulates on coil C2, i.e. until coil C2 freezes up, to the point where the ice impedes the flow of air through coil C2 to such an extent as to cause air pressure to build up in the ductwork 21 upstream of coil C2 to the point where it signals the computer-controlled device 81 to deliver control air (at 15 psi for example) through line 75 to the control ports A of the valves V1–V4. Thereupon, the valves shift to their stated second setting (ports U open to ports C and ports B blocked) and the apparatus operates in the stated second mode wherein coolant from the first source 9 (e.g. 40° F. coolant) is circulated through coil C2 and coolant from the second source (e.g. 20° F. coolant) is circulated through the coil C1.

Coolant at the temperature above the freezing point of water flowing through coil C2 melts the ice on coil C2, removing the impediment to flow of air through coil C2, resulting in drop of air pressure in the ductwork 21 upstream of coil C2. On sufficient drop of air pressure, as sensed by pressure sensor 77, the computer-controlled device 81 cuts off delivery of control air through line 75 to the valves V1–V4 and vents this line (and control ports A), causing the valves to shift back to their stated first setting, and resulting in operation of the apparatus in the stated first mode, continuing in this mode until coil C2 freezes up, the cycle of operation in the first mode followed by operation in the second mode being repeated.

On operation of the apparatus in the first mode, moisture in the air flowing through coils CP, C1 and C2 is removed by condensation on the coils, most if not all of the moisture remaining in the air after passage through coils CP and C1 condensing on coil C2. On operation of the apparatus in the second mode, moisture in the air flowing through the coils is also removed by condensation on the coils, whatever moisture remaining in the air after passage through coils CP and C1 being subject to condensation in passing through coil C2. Coil C1 is de-iced on operation of the apparatus in the first stated mode and coil C2 is de-iced on operation of the apparatus in the stated second mode, for efficient and reliable dehumidification.

Figure 2:
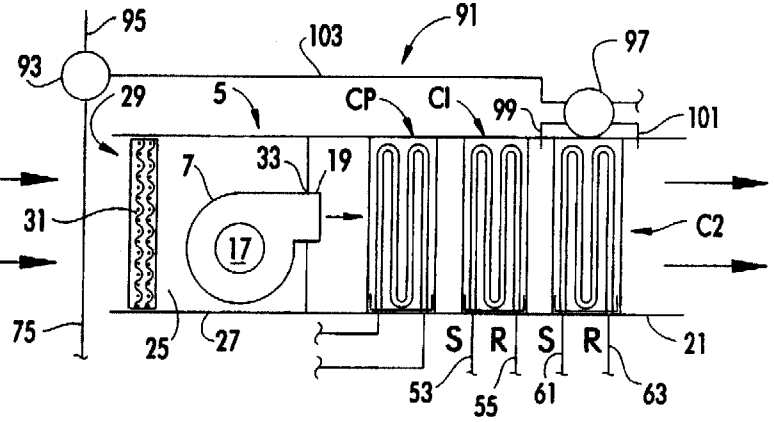
FIG. 2 is a semi-diagrammatic view including part of FIG. 1 and showing a modification of said first version.

It will be observed that as shown in FIG. 1 the means 15 for controlling the valving comprises means responsive to the pressure of air (as sensed by pressure sensor 77) in the ductwork 21 upstream from coil C2. FIG. 2 illustrates a modification of means 15 shown in FIG. 1 for controlling the valves V1–V4 involving the provision of means such as indicated at 91 responsive to drop of air pressure across coil C2 instead of means responsive to pressure upstream of this coil. More particularly, this means comprises a solenoid valve 93 supplied with control air (e.g. at 15 psi pressure) from a source as indicated at 95 controlling delivery of control air to control air line 75 generally the same as in FIG. 1. Valve 93 has a first setting in which it vents line 75 and a second setting in which it supplies control air to line 75. It is controlled by a pressure drop sensing switch 97, which in turn is controlled by two pressure probes 99 and 101 extending into the ductwork 21, one upstream from and the other downstream from the coil C2. Switch 97 is activated in response to increase in the pressure drop across coil C2 (resulting from freezing up of this coil) above a set limit to deliver a signal via line 103 to the solenoid valve 93 to cause it to shift from its first to its second setting for shifting operation of the apparatus from the stated first mode to the stated second mode. On reduction in the pressure drop on de-icing of coil C2, switch 97 is deactivated, and the solenoid valve cuts off delivery of control air to and vents line 75 for shift to the first mode.

Figure 3:
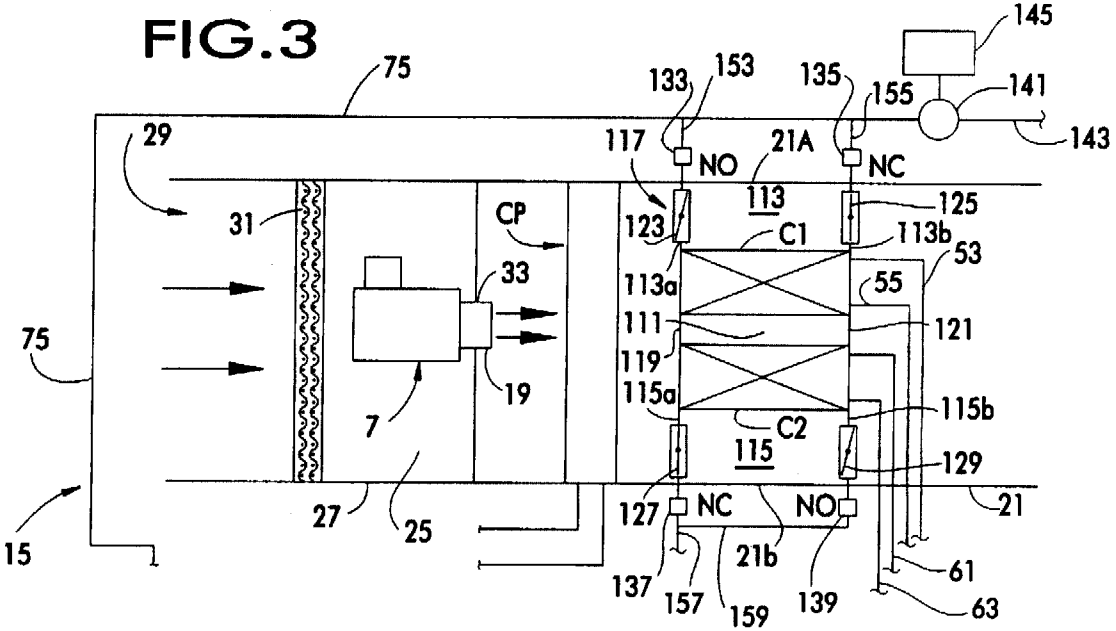
FIG. 3 is a semi-diagrammatic view illustrating a second version of the apparatus.

FIG. 3 illustrates a second version of the dehumidifying apparatus of this invention wherein not only is there a reversal of flow of the two coolants in the operation of the apparatus in the first mode and the operation of the apparatus in the second mode, but there is also a reversal of flow of air through the coils C1 and C2, so that air flows first through coil C1 and then through coil C2 in the first mode, and first through coil C2 and then through coil C1 in the second mode, so that in each mode, the last coil through which the air flows is the coil which has the low-temperature coolant circulating therethrough. This enables use of low-temperature coolant at a lower temperature then in the FIGS. 1 and 2 versions of the apparatus, e.g. coolant at a temperature of 15° F. instead of 20° F., for even greater efficiency.

In the FIG. 3 version of the apparatus, the coils C1 and C2 are positioned extending lengthwise in the ductwork 21 (instead of transversely of the ductwork as in FIGS. 1 and 2) with a first space 111 between the coils, and a second space 113 between coil C1 and the adjacent side 21*a* of the ductwork, and a third space 115 between the coil C2 and the other side 21*b* of the ductwork. Thus, space 113 extends lengthwise of the ductwork at the left of the ductwork as viewed in downstream direction and space 115 extends lengthwise of the ductwork inside of the ductwork at the right of the ductwork as viewed in downstream direction. Space 113 has upstream and downstream ends indicated at 113*a* and 113*b*, and space 115 has upstream and downstream ends indicated at 115*a* and 115*b*. Means generally indicated at 117 is provided in the ductwork for directing air to flow first through coil C1 and then through coil C2 in the first mode of operation of the apparatus wherein the higher temperature coolant (e.g. 40° F. coolant) flows through coil C1 and the lower temperature coolant (e.g. 15° F. coolant) flows through coil C2, and first through coil C2 and then through coil C1 in the second mode of operation wherein the higher temperature coolant flows through coil C2 and the lower temperature coolant flows through coil C1.

The air-directing means 117 comprises panels 119 and 121 closing the ends of the space 111 between the coils C1 and C2, first and second valve means 123 and 125 for opening and closing the upstream and downstream ends 113*a* and 113*b*, respectively, of space 113 and third and fourth valve means 127 and 129 for opening and closing the upstream and downstream ends 115*a* and 115*b*, respectively, of space 115. As indicated in FIG. 3, each of the four stated valve means 123, 125, 127 and 129 may be in the form of a damper swingable on a vertical axis between an open and a closed position at the respective ends 113*a*, 113*b*, 115*a* and 115*b* of spaces 113 and 115. Air-activated drives indicated at 133, 135, 137 and 139 are provided for activating the four dampers 123, 125, 127 and 129, respectively. Each of the four damper drives may be of a conventional type having a driven member normally spring-biased to a first position (retracted position) and operable on being fed air under pressure to move the driven member to a second position (an advanced position). The driven members of these drives are connected to the respective valve members or dampers, the arrangement being such that with the driven members of drives 133 and 139 retracted, dampers 123 and 129 are open (normally open) and with the driven members of drives 135 and 139 advanced, dampers 125 and 127 are closed (normally closed). This condition is illustrated in FIG. 3, the notations NO and NC referring to the normally open condition of dampers 123 and 129 and the normally closed condition of dampers 135 and 137.

The FIG. 3 apparatus utilizes the same hydraulic circuit 13 (including valves V1–V4) as used in the two versions of the apparatus shown in FIGS. 1 and 2, the valves in the circuit of the FIG. 3 apparatus being controlled by a system corresponding to system 15 of the apparatus shown in FIGS. 1 and 2 (and again indicated at 15 in FIG. 3) including control air line 75 (connected to the control ports A of valves V1–V4). In the FIG. 3 apparatus, the control means for controlling delivery of control air via line 75 comprises a solenoid valve 141 supplied with air under pressure (e.g. 15 psi) from a source indicated at 143, this solenoid valve being controlled by a timer 145 having switch means interconnected with the solenoid valve operable to effect timed periods in which the valve is off (cutting off the supply of air to line 75 and venting it) alternating with timed periods in which the solenoid valve is on for supplying control air (at 15 psi, for example) to line 75. The timer is adjustable for setting different time periods. The line 75 has branch connections such as indicated at 153, 155, 157 and 159 to the air-operated damper drives 133, 135, 137 and 139. Thus, during the periods when the solenoid valve 141 is de-energized, line 75 is vented and the valves V1–V4 are set for operation of the apparatus in the first mode, the driven members of drives 133 and 139 are retracted so that dampers 123 and 129 are open and dampers 125 and 127 are closed, whereby air delivered by the blower flows through space 113, coil C1, space 111, coil C2, space 115 and out of the latter. During the periods when the solenoid valve is energized, air is delivered through line 75 to the control ports of the valves V1–V4 to set them for operation of the apparatus in the second mode; and also delivered via branch lines 153, 155, 157 and 159 to the air-operated drives 133, 135, 137 and 139 to drive the driven members of these drives to their advanced position so that dampers 123 and 129 are closed and dampers 127 and 125 are open whereby air delivered by the blower flows through space 115, coil C2, space 111, coil C1, space 113 and out of the latter. Thus, air flows first through coil C1 and then coil C2 on operation of the apparatus in the first mode, and first through coil C2 and then coil C1 on operation of the apparatus in the second mode. The time period for operation in the first mode and flow through coil C1 and then coil C2 and the time period for operation in the second mode and flow through coil C2 and then coil C1 may be determined empirically.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. Air dehumidifying apparatus comprising:

two cooling coils in series;

means for blowing air to be dehumidified through the coils for condensation of moisture from the air thereon;

a first source of coolant at a temperature above 32° F., and below the dew point of the air;

a second source of coolant at a temperature below 32° F.;

said coils being connected with said sources of coolant in a circuit including valving for alternate operation of the apparatus in a first mode for circulation of coolant from the first source through one coil and circulation of coolant from the second source through the other coil and a second mode for circulation of coolant from the second source through said one coil and circulation of coolant from the first source through said other coil; and means for controlling the valving for effecting operation of the apparatus in cycles with each cycle involving operation of the apparatus in the first mode until said other coil freezes up and then shifting to operation in the second mode until said one coil freezes up, and then shifting to operation in the first mode, and repeating the cycle.

2. Air dehumidifying apparatus as set forth in claim 1 wherein the means for controlling the valving comprises means responsive to the pressure of air between the coils.

3. Air dehumidifying apparatus as set forth in claim 1 wherein the means for controlling the valving comprises means responsive to drop of air pressure across one of the coils.

4. Air dehumidifying apparatus as set forth in claim 1 wherein the means for controlling the valving comprises a timer for timing operation of the apparatus in said first and second modes.

5. Air dehumidifying apparatus as set forth in claim 1 wherein the means for blowing air through the coils comprises means defining a chamber having an inlet for admission thereto of air to be dehumidified and an outlet, a blower in the chamber for blowing air through the outlet, and ductwork in communication with the outlet for flow of the air therethrough, the coils being located in the ductwork.

6. Air dehumidifying apparatus as set forth in claim 5 wherein, with the blower in operation, air flows continuously in one direction through the ductwork first through a first of the coils then through a second of the coils in series.

7. Air dehumidifying apparatus as set forth in claim 6 having an auxiliary cooling coil in the ductwork upstream from said first cooling coil, said auxiliary coil being supplied with coolant at a temperature above 32° F. and below the dew point of the air.

8. Air dehumidifying apparatus as set forth in claim 6 wherein the valving comprises a plurality of valves interconnected with said sources of coolant and with one another and with said first and second coils in said circuit, each valve having a first setting for operation of the apparatus in the first mode and a second setting for operation of the apparatus in the second mode, each valve normally being in one of its settings, and wherein the means for controlling the valving comprises means operable in response to icing of one of the coils to set each of the valves in its other setting.

9. Air dehumidifying apparatus as set forth in claim 8 wherein the means operable in response to icing of one of the coils comprises means responsive to the pressure of air in the ductwork between the coils.

10. Air dehumidifying apparatus as set forth in claim 9 wherein each valve is a pneumatically controlled valve having a pneumatic control port, each valve being in its first setting on zero pressure of control air at its said control port, and shifting to its second setting on delivery of a control air pressure signal to its said control port, said means responsive to the pressure of air in the ductwork between the coils comprising means for delivering a control air pressure signal to the control port of each valve in response to icing of one of the coils.

11. Air dehumidifying apparatus as set forth in claim 8 wherein the means operable in response to icing of one of the coils comprises means responsive to the pressure of air in the duct between the coils.

12. Air dehumidifying apparatus as set forth in claim 8 wherein the means operable in response to icing of one of the coils comprises means responsive to drop of air pressure in the duct across said one coil.

13. Air dehumidifying apparatus as set forth in claim 1 further comprising means for directing air to flow first through said one coil and then through said other coil on operation of the apparatus in one of said modes and to flow first through said other coil and then through said one coil on operation of the apparatus in the other of said modes.

14. Air dehumidifying apparatus as set forth in claim 5 further comprising means in said ductwork for directing air to flow first through said one coil and then through said other coil on operation of the apparatus in one of said modes and to flow first through said other coil and then through said one coil on operation of the apparatus in the other of said modes.

15. Air dehumidifying apparatus as set forth in claim 14 wherein the coils are positioned extending lengthwise in the ductwork with a first space between the coils, a second space between one coil and the adjacent side of the ductwork, and a third space between the other coil and the other side of the ductwork, said spaces having upstream and downstream ends, and wherein the means for directing air comprises means closing the upstream and downstream ends of the first space, a first damper at the upstream end of the second space, a second damper at the downstream end of the second space, a third damper at the upstream end of the third space and a fourth damper at the downstream end of the third space, said apparatus having means for opening and closing the dampers, the apparatus being operable in the first mode with the first and fourth dampers open and the second and third dampers closed for flow of air first through said one coil and then through said other coil, and in the second mode with the third and second dampers open and the first and fourth dampers closed for flow of air first through said other coil and then through said one coil.

* * * * *